US007059921B2

(12) United States Patent
Mulot

(10) Patent No.: US 7,059,921 B2
(45) Date of Patent: Jun. 13, 2006

(54) FEMALE ELECTRICAL CONTACT

(75) Inventor: Gerard Mulot, Nogent le Roi (FR)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/482,581

(22) PCT Filed: Jun. 28, 2002

(86) PCT No.: PCT/EP02/07188

§ 371 (c)(1),
(2), (4) Date: Jun. 1, 2004

(87) PCT Pub. No.: WO03/003523

PCT Pub. Date: Jan. 9, 2003

(65) Prior Publication Data

US 2005/0026513 A1 Feb. 3, 2005

(30) Foreign Application Priority Data

Jun. 29, 2001 (FR) ..... 01 08841

(51) Int. Cl.
*H01R 11/22* (2006.01)

(52) U.S. Cl. ..... 439/852

(58) Field of Classification Search ..... 439/851, 439/852, 842, 843
See application file for complete search history.

(56) References Cited

U.S. PATENT DOCUMENTS

| | | | | |
|---|---|---|---|---|
| 5,624,289 | A * | 4/1997 | Kourimsky et al. | 439/852 |
| 5,897,405 | A | 4/1999 | Endo | 439/852 |
| 5,951,339 | A * | 9/1999 | Chaillot et al. | 439/852 |
| 6,447,345 | B1 * | 9/2002 | Sato et al. | 439/852 |
| 6,579,132 | B1 * | 6/2003 | Sato et al. | 439/852 |

FOREIGN PATENT DOCUMENTS

| | | | |
|---|---|---|---|
| EP | 0310487 | A1 | 4/1989 |
| EP | 0812034 | A1 | 12/1997 |
| FR | 2769413 | A1 | 4/1999 |
| WO | WO-96/12324 | A1 | 4/1996 |

* cited by examiner

*Primary Examiner*—Tho D. Ta
(74) *Attorney, Agent, or Firm*—Harrington & Smith, LLP

(57) ABSTRACT

The invention relates to a one-piece female electrical contact (1) which is cut and folded and which comprises, longitudinally, a rear area for connecting to an electrical conductor, a protective cage, which consists of a floor (4), two lateral walls (5, 6) and at least one ceiling element, and, on the front, a termination which is in contact with a complementary male contact. Said contact termination consists of at least one elastic contact blade (8, 9) comprising a blade which is connected to the rear of at least one ceiling element (22) and which extends towards the rear before folding.

11 Claims, 5 Drawing Sheets

FEMALE ELECTRICAL CONTACT

FIELD OF THE INVENTION

A number of female electrical contacts are known, particularly contacts in which the contact terminal to a complementary contact comprises spring contact tines arranged in the interior of a protective structure that forms a protective housing either completely around the tines or partially around the front or the rear of the tines.

BACKGROUND OF THE INVENTION

A known female electrical contact of the one-piece [monobloc] type with a protective housing is described, for example, in the document EP 0 310,487. This one-piece contact is formed from a single metal flank and comprises two contact tines that are bent back from top elements of the housing by a bend of 180° along axes that are parallel to the main axis of the contact, the tines thus comprising connecting parts to the top element that conform to the internal profile of the housing in the region of the top element and of the side walls of the housing.

SUMMARY OF THE INVENTION

In this contact, the pretensioning retainer flaps of the spring contact tines and of the guide of the complementary male contact are made by bending from the front of the side walls of the housing.

This contact affords a very good protection of the contact tines and a considerable rigidity of the housing, but it necessitates a considerable width of metal strip in order to produce it.

An embodiment subsequent to the patent EP 0 310,487 is also described in the document FR 2,751,793. This embodiment is constructed in a longitudinal direction from a single flank and comprises, through the forward extension of the bottom in front of the tines, a structure that, once bent back along an axis that is perpendicular to the longitudinal axis of the contact, forms a front wall, this front wall being perforated in order to form a frame provided with pretensioning flaps of the contact tines and being extended by the elements of the protective housing of the contact tines that comprise zones of support for the locking tabs coming from the box.

Such an embodiment, for which elements of the housing wall that comprise zones of support for the locking tabs coming from the box are connected to the body of the contact through terminal arms that are bent in the region of the tops of a frame, introduces a risk of breakage of these arms and considerable constraints in the region of these arms, particularly in the case of contacts used in automobile applications, for which a contact section of the order of one to four square millimeters is common.

In addition, a full protection of the tines by bending an extended structure from the front to the rear leads to an increase in the width of the metal strip used and to a considerable increase in the operation of cutting and bending tools, which can limit the speed of fabrication and can introduce flaws in uniformity and quality into the contacts obtained.

In a manner so as to ensure a good protection of the contact tines in their entirety, while maintaining a large rigidity of contact, the invention proposes a cut and bent, one-piece, female electrical contact comprising, in the longitudinal direction, a rear zone of connection to an electrical conductor, a protective housing comprising a bottom, two side walls adjacent to the bottom and bent back along a longitudinal axis, and at least one top element, this electrical contact comprising, on the front, a contact terminal, which is situated in the housing, to a complementary male contact, this terminal contact terminal being formed by at least one spring contact tine provided with a terminal part pointed towards the front of the contact, a contact for which this spring contact tine is constructed from a small strip that is joined to the rear of the top element, this small strip extending, prior to bending, towards the rear and, after bending, towards the front and perpendicularly to the bottom.

Advantageously, the bending of the small strip that forms the tine includes a twisting.

In particular, this contact tine can comprise, in the region of its connection to the top element, a first bend along an axis that is perpendicular to the longitudinal axis of the contact, a first section extending away from the top element, a second biased bend forming a second section, and a third bend defining the rear part of a spring section that is joined to a convex section of contact to a complementary contact.

Advantageously, the second section includes an edge that is supported against the top element.

The contact can include a retainer flap for pretensioning the terminal part of the tine, this flap being bent back from the front of the side wall with respect to the tine, the tine comprising, on its part, in front of the zone of contact, a section of support against the flap.

More specifically, the contact can include the means of retention in a contact carrier box; these means can include either at least one opening introduced into a side wall or at least one tab constructed on one of the sides of the housing.

In one particularly advantageous embodiment, a contact in accordance with the invention will comprise at least one pair of tines and one pair of top elements, each of the tines of the pair of tines being joined to one top element of the pair of top elements.

In a particular embodiment, the flap can include anchoring lugs, the bottom and the top element containing the receiving holes for these lugs.

The contact in accordance with the invention can also include a stiffening device in the linking region between the rear zone of connection and the housing, the stiffening device being formed by arches joining the top part of the side walls and an extension of the bottom adjoining the crimp tabs of an electrical wire.

BRIEF DESCRIPTION OF THE DRAWING

The invention will be better understood by reading the description that follows of non-limiting examples of embodiment of contacts in accordance with the invention, referring to the figures, which represent.

Figure 2:
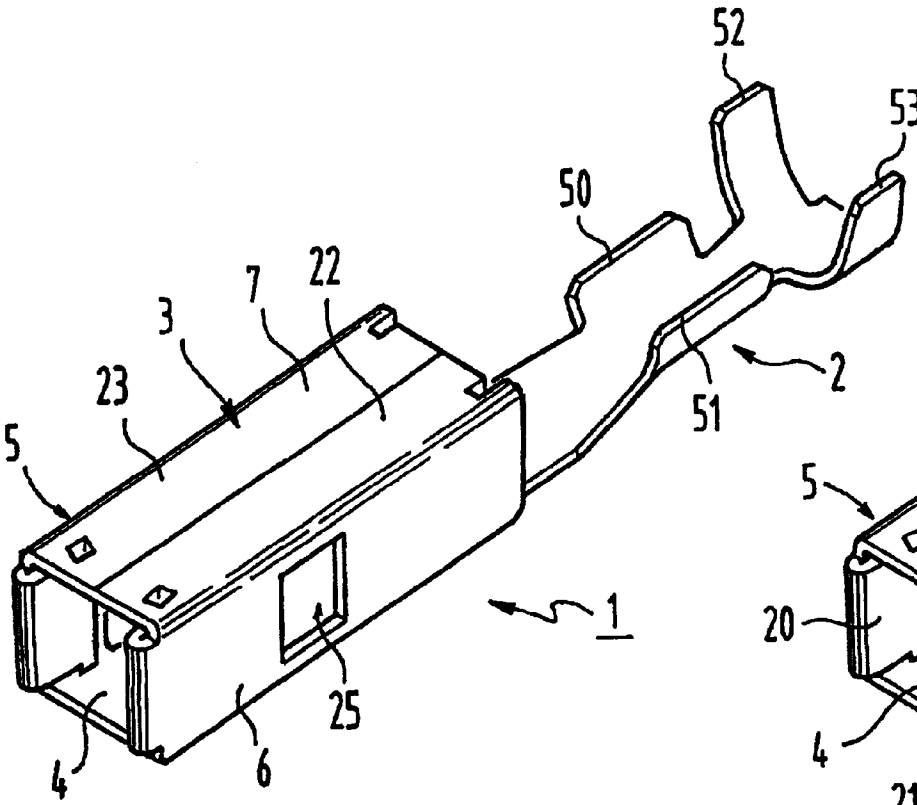
In FIG. 2: A perspective view from the front of a first example of the contact in accordance with the invention.

The female electrical contact 1 shown in FIG. 2, by way of example, is of the cut and bent, one-piece type comprising, in the longitudinal direction, a rear zone 2 of connection to an electrical conductor. Even though other types of connection, such as a stripped insulation terminal or a soldered tab, are conceivable, the zone represented here is of the type that is crimped with the crimp tabs 50, 51 on a stripped end of a conductor and with the crimp tabs 52, 53 on the insulator of the conductor.

DETAILED DESCRIPTION OF THE INVENTION

Figure 4:
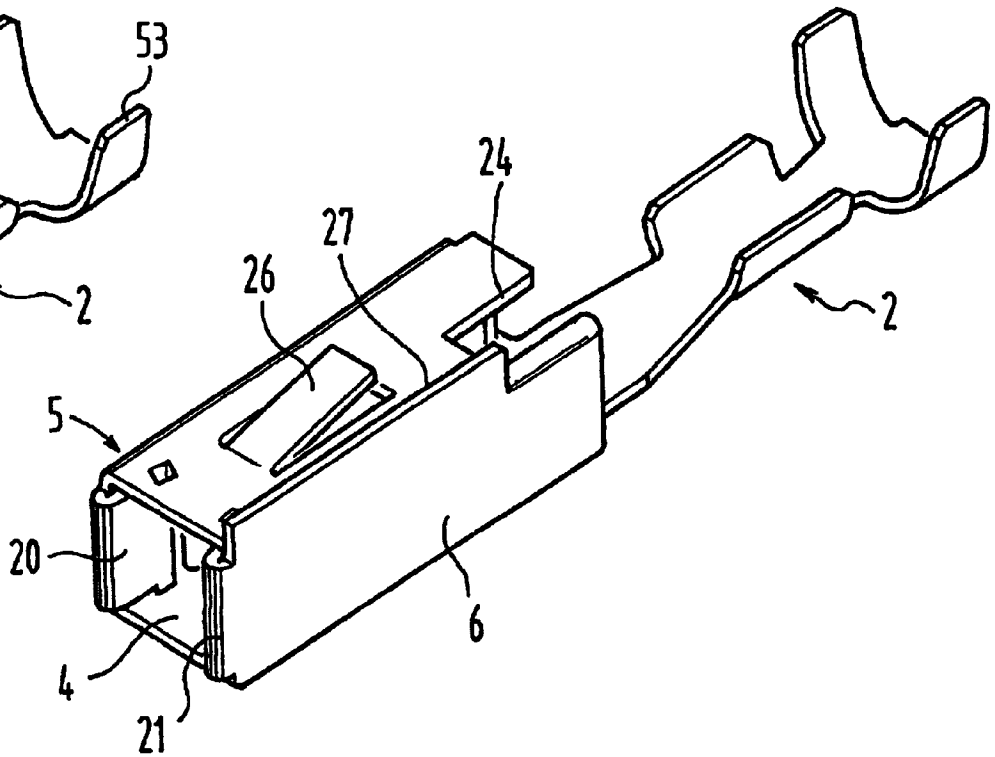
In FIG. 4: A perspective view from the front of a second example of the contact in accordance with the invention.
Figure 6:
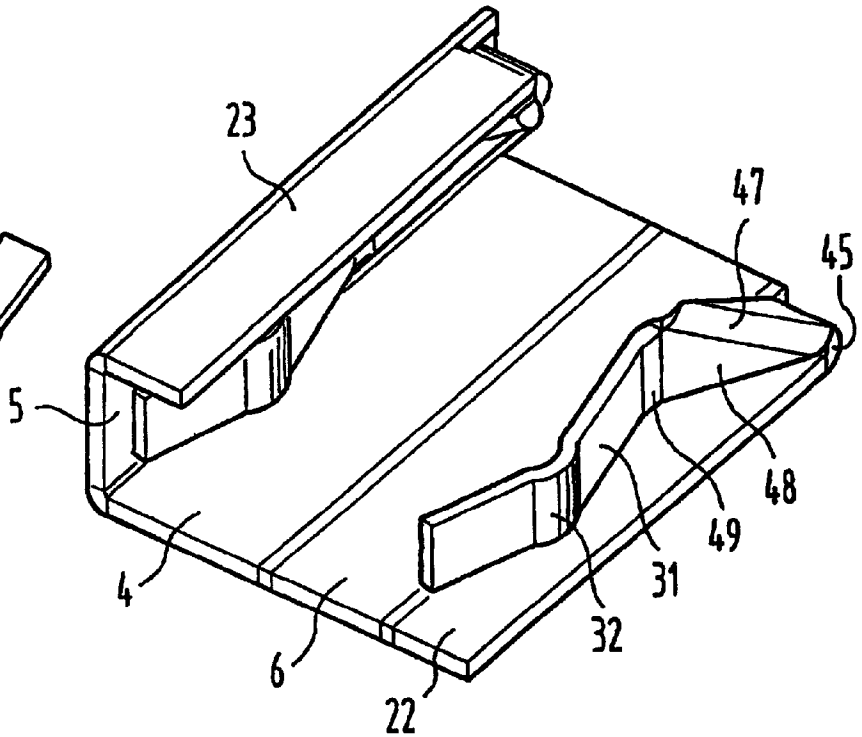
In FIG. 6: A section of a contact in accordance with the invention in a second phase of intermediate bending.

Joined to this zone of connection by a linking area that is continuous with the bottom 4, the contact represented in FIG. 2 or 4 has a protective housing 3, which is comprised of the bottom 4, the two side walls 5, 6, and a contact terminal, which is situated on the front and in the interior of the housing, to a complementary male contact, this contact terminal being formed in the example represented in FIG. 6, for example, by two spring contact tines 8, 9, each being provided with a terminal part 10, 11 pointed towards the front of the contact.

Figure 1:
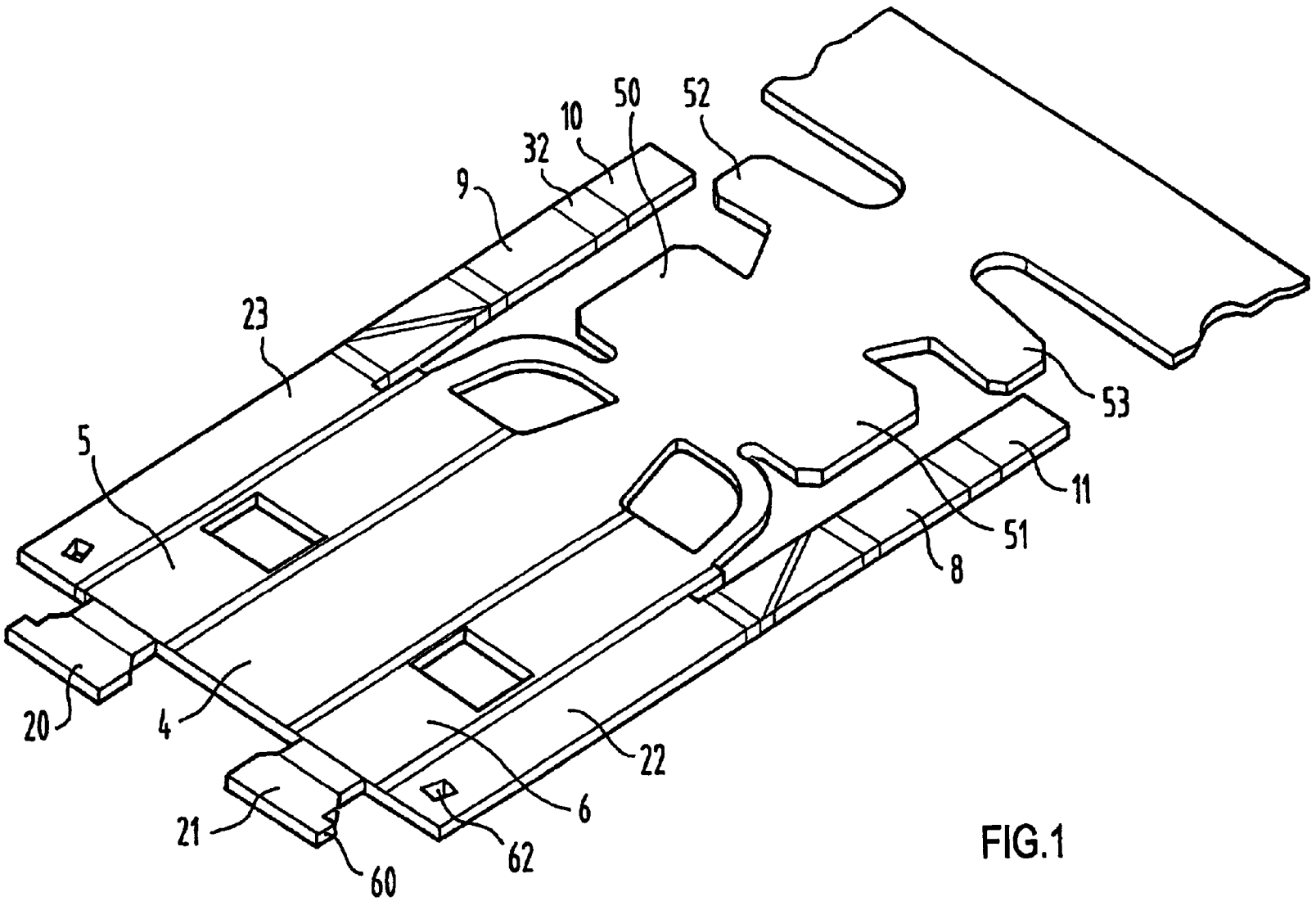
In FIG. 1: A view of an element made of a metal strip, after cutting and before bending, intended to embody a first example of the contact in accordance with the invention.
Figure 3:
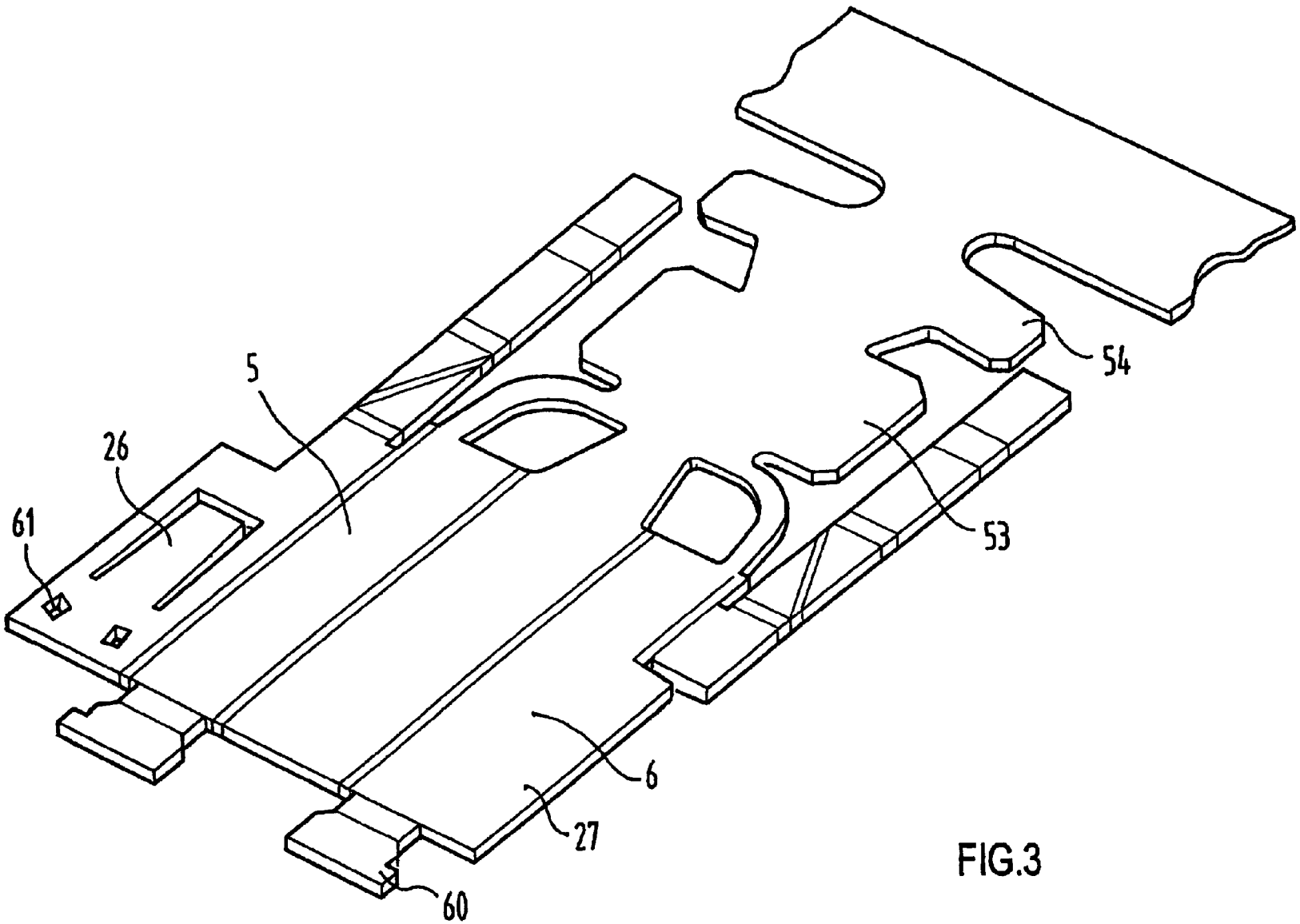
In FIG. 3: A view of an element made of metal strip, after cutting and before bending, intended to embody a second example of the contact in accordance with the invention.

The contact is constructed from a single flank, as represented in FIGS. 1 and 3, for which the side walls 5 and 6 are side extensions adjoining the bottom along an axis that is transverse to the contact. In order to form the sides of the housing, the extensions are bent back along an axis that is parallel to the longitudinal axis of the contact. In order to complete the housing, the top elements are bent back and joined to these side walls.

Still according to FIGS. 1 to 3, the spring contact tines are constructed in every case from small strips joined to the rear of the top elements and extending, prior to bending, towards the rear of the contact parallel to the bottom. This arrangement minimizes the developed surface of the contact, making it possible to minimize waste pieces of material being formed during the cutting and to increase the density of the contacts, while reducing the step between contacts on the strip.

Figure 5:
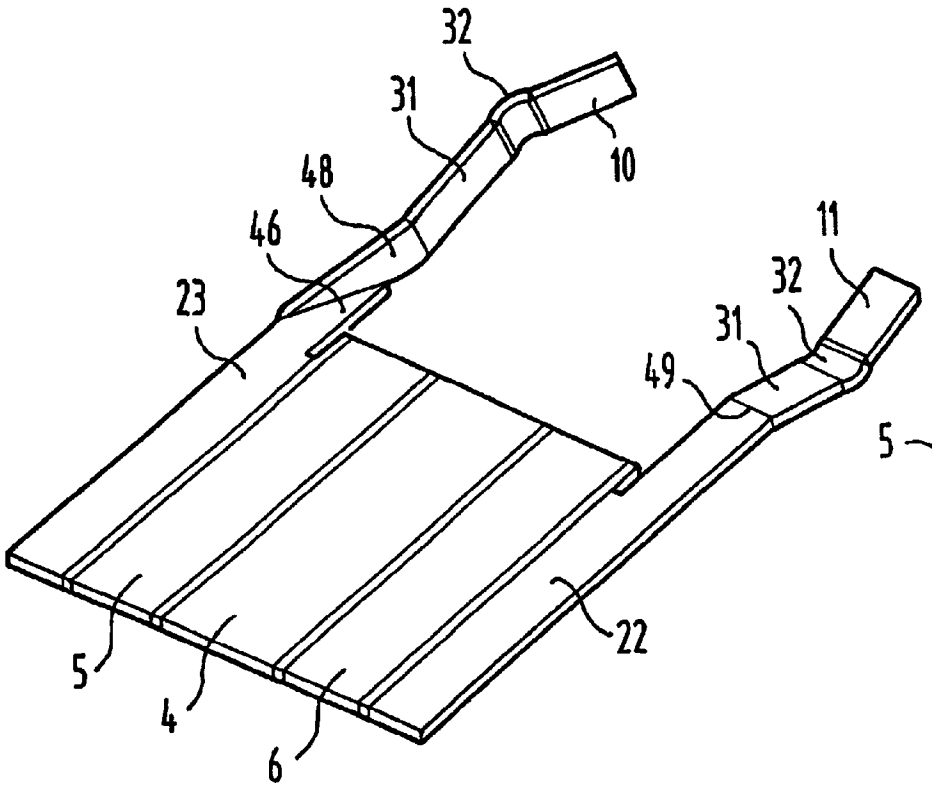
In FIG. 5: A section of a contact in accordance with the invention in a first phase of intermediate bending.
Figure 7:
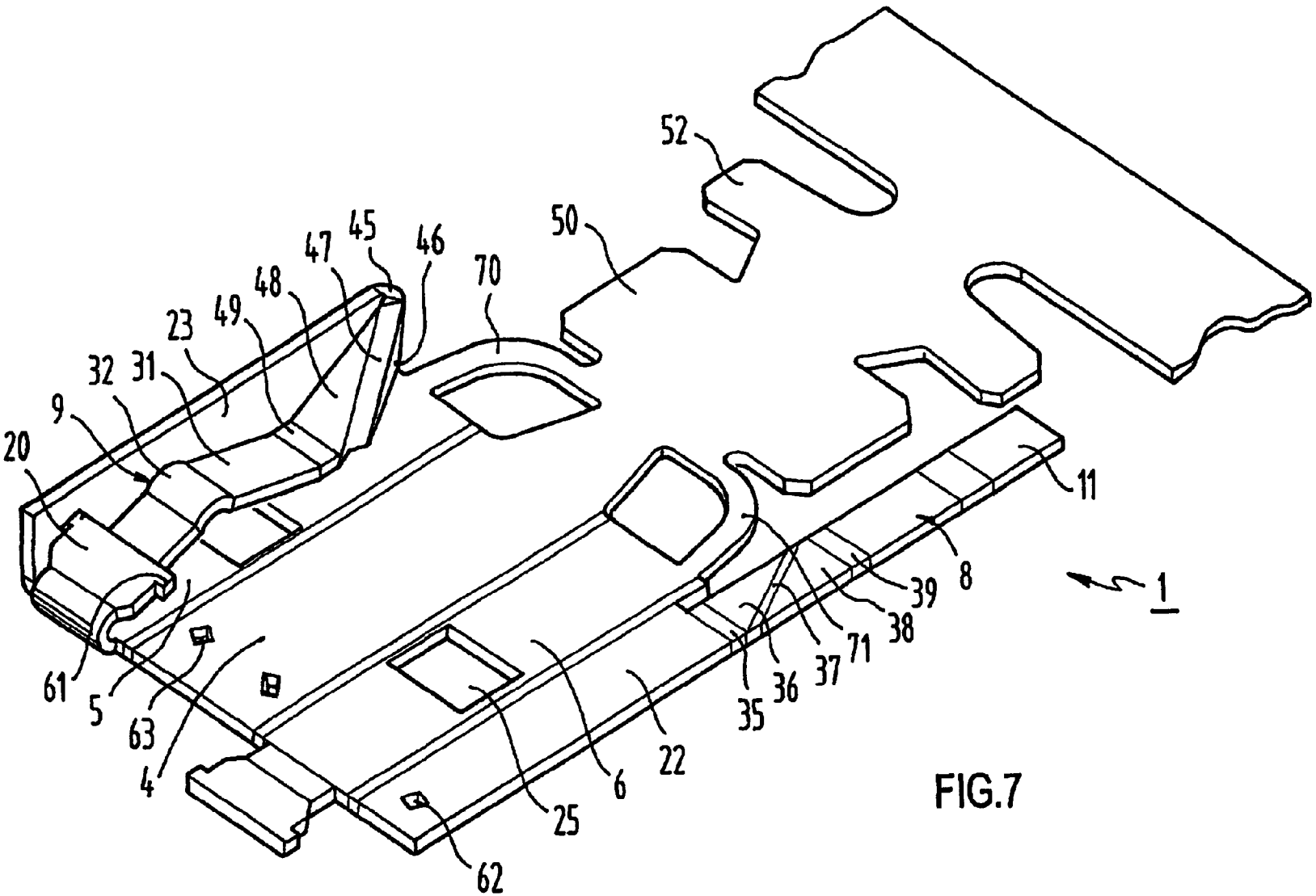
In FIG. 7: A perspective view of a contact in accordance with the invention that is partially unbent.

In order to construct the contact, the tines, which are situated, after oriented cutting, towards the rear of the contact, are laid down from the rear towards the front. The extended positioning of the top elements allows them to be bent back following a sequence that creates a twisting of the tines. An example of the sequence of bending is represented in FIGS. 5 and 6, showing, in order, the chosen operations: the right side of FIG. 5 shows a first bending operation that forms the spring section 31 of the tine from the bend 49, the convex section 32, and the terminal part 11 of the tine; the left side of FIG. 5 shows the biased bending operation between the sections 46 and 48 that creates the twisting of the tine; the right side of FIG. 6 shows the operation of bending from the rear towards the front around the axis 45 that is perpendicular to the longitudinal direction of the contact; and the left side of FIG. 6 shows the half-housing formed after the bending of the bottom and of the side wall.

The complete bending of the tine from the rear towards the front consists of a first bend (45) along an axis that is perpendicular to the longitudinal axis of the contact, this bend turning the tine back towards the front. The bending includes a second biased bend (47) carried out along the diagonal of a first section of the tine, this bend creating a section (48) that is generally triangular and is situated in a plane that is perpendicular to the top, this section including a free edge that is possibly supported against the top element. The bending of the tine includes, at its conclusion, a third bend (49) carried out at one end of the triangular section along an axis that is perpendicular to the top, in such a way as to form the active part of the contact tine, this tine comprising, in a traditional manner, a first spring section, a convex zone of contact to a complementary contact pin or tongue, which is in itself known, and a terminal free zone.

This sequence of bends, bringing about a twisting of the tine, makes it possible, starting from flanks extending towards the rear, to construct contact tines that, prior to bending of the elements of the housing, are situated in a plane perpendicular to the top elements and, after bending of the housing, that is, after bending by 90° of the top elements in relation to the side walls and then bending by 90° of the side walls in relation to the bottom, are found arranged along the length of the side walls of the housing.

This formation of a contact tine from top elements by twisting avoids having a projection in the rear of the housing in the region of the rear edge of the side wall adjacent to the tine, this wall being thus able to serve as support surfaces for a locking element of the contact in a receiving socket of an insulating box receiving the contact.

The section of the tine having the biased bend affords the advantage of constituting a stiffening zone of the tine and thus stiffens the rear part of the housing.

When the section 48 is extended, the tine or the tines present an intermediate section 31 extending away from the side face. This section forms the spring part of the tine and influences the contact pressure to a complementary contact pin or prong. The zone of contact with the complementary contact is realized, as already seen, by a convex section 32.

The contact tine is terminated towards the front by a terminal section 11 of support against a flap 20, 21, set in the front of the side face to which it is joined.

The presence of this flap brings about a retaining and a pretensioning of the tine in such a way as to define clearly the position of the point of contact of the tine to a complementary contact pin. In the case of a joint contact of two opposite spring tines, each pretensioned by a flap, there is also a definition of play between the convex sections, which fixes the minimal thickness of the pin or of the prong received between the tines. Moreover, the flaps protect the contact tines and guide the pin during its introduction into the housing.

In order to rigidify the front of the housing and to maintain the flaps in a precise position, the latter have lugs 60, 61, which are intended to be received in the holes 62, 63 constructed in the bottom and in a top of the housing.

According to FIGS. 1 and 2, which represent a contact of two opposite tines and a housing without polarization, the latter housing comprises the symmetrical half tops 22, 23. Represented in FIGS. 3 and 4 is a polarized contact for which a major part of the top is constructed from a single side wall 6 of the contact extended by a flank 24. In this embodiment, it is possible to provide, in a known manner, a flange 27 for polarization of the contact and for protection of a locking tab 26 of the contact in a receiving socket of an insulating box. This flange is thus formed by an extension of the side wall 5. During the closing of the housing, it is possible to firmly join the wall 5 and the top 24 by soldering or by a pin device, as known in the field.

The means of maintaining the contact in the insulating receiving box of this contact can comprise at least one opening 25 introduced on one of the sides of the housing or, as described above, at least one tab 26 constructed on one of the sides of the housing.

The opening or the openings can be located on the side walls of the housing behind the tines; the tab or the tabs can be situated on one face or on any of several faces of the housing.

As shown in FIGS. 1 and 2, the contact in accordance with the invention can include a stiffening system in the rear of the housing, this stiffening system being formed of arches that join the top of the side walls to the zone that connects the bottom to the zone of connection with an electrical wire. These arches are also advantageous for defining a receiving opening of a locking pin of the contact. These arches are formed during the general bending of the contact itself in order to form the side walls and the zone of connection to an electrical wire.

According to the attached figures, the contact includes a pair of spring tines constructed symmetrically from the top elements. In the scope of the invention, it is conceivable to consider a contact for which the tines are doubled in their spring part and in their contact to a complementary pin (31, 32, 11) or also to consider a contact for which one tine is constructed according to the principle of twisting, this tine being arranged with respect to a support surface of the differently constructed pin or with respect to a tine cut in the opposing side wall.

The invention is not limited to the examples described in the figures and applies, in particular, to an electrical contact provided with any rear zone of connection.

The invention claimed is:

1. A cut and bent, one-piece, female electrical contact comprising, in the longitudinal direction, a rear zone of connection to an electrical conductor, a protective housing comprising a bottom (4), two side walls (5, 6) adjacent to the bottom (4) and bent back along a longitudinal axis, and at least one top element (22, 23), this electrical contact comprising, on a front, a contact terminal, which is situated in the housing, to a complementary male contact, this contact terminal being formed by at least one spring contact tine (8) provided with a terminal part (10) pointed towards the front of the contact, characterized in that said spring contact tine is constructed from a small strip that is joined to a rear of the top element, this small strip extending, prior to bending, towards the rear and, after bending, towards the front, wherein after bending the contact tine including the terminal part is orientated generally perpendicular to the bottom.

2. The female electrical contact according to one of claim 1, further characterized in that the tine has, in the region of its connection to the top element, a first bend (45) along an axis that is perpendicular to a longitudinal axis of the contact, a first section (45) extending away from the top element, a second biased bend (47) forming a second section (48), and a third bend (49) defining a rear part of a spring section (31) that joined to a convex section (32) of contact to a complementary contact.

3. The electrical contact according to claim 2, further characterized in that the second section (48) includes an edge supported against the top element (23).

4. The electrical contact according to claim 1, further characterized in that the contact includes means (25, 26) of retention in a contact carrier box.

5. The electrical contact according to claim 4, further characterized in that these means include at least one opening (25) introduced into a side wall of the contact.

6. The electrical contact according to claim 4, further characterized in that these means include at least one tab (26) constructed on one of the side walls of the housing.

7. The electrical contact according to claim 1, further characterized in that the contact includes a retainer flap (20) for pretensioning the terminal part (10) of the tine, this flap being bent back from a front of the side wall (5) with respect to the tine, the tine comprising, on its part, in front of a contact zone, a section of support against the flap.

8. The electrical contact according to claim 7, further characterized in that the flap includes anchoring lugs (60, 61), the bottom and the top element containing receiving holes (62, 63) for these lugs.

9. A cut and bent, one-piece, female electrical contact comprising, in the longitudinal direction, a rear zone of connection to an electrical conductor, a protective housing comprising a bottom, two side walls adjacent to the bottom and bent back along a longitudinal axis, and at least one top element, this electrical contact comprising, on a front, a contact terminal, which is situated in the housing, to a complementary male contact, this contact terminal being formed by at least one spring contact tine provided with a terminal part pointed towards the front of the contact, characterized in that said spring contact tine is constructed from a small strip that is joined to a rear of the top element, this small strip extending, prior to bending, towards the rear and, after bending, towards the front, wherein the bending of the small strip forming the tine comprises a twisting.

10. A cut and bent, one-piece, electrical contact comprising, in the longitudinal direction, a rear zone of connection to an electrical conductor, a protective housing comprising a bottom, two side walls adjacent to the bottom and bent back along a longitudinal axis, and at least one top element, this electrical contact comprising, on a front, a contact terminal, which is situated in the housing, to a complementary male contact, this contact terminal being formed by at least one spring contact tine provided with a terminal part pointed towards the front of the contact, characterized in that said spring contact tine is constructed from a small strip that is joined to a rear of the top element, this small strip extending, prior to bending, towards the rear and, after bending, towards the front, wherein the contact further includes at lease one pair of the tines (8, 9) and one pair of the top elements (22, 23), each of the tines of the pair of tines being joined to one top element of the pair of top elements.

11. A cut and bent, one-piece, electrical contact comprising, in the longitudinal direction, a rear zone of connection to an electrical conductor, a protective housing comprising a bottom, two side walls adjacent to the bottom and bent back along a longitudinal axis, and at least one top element, this electrical contact comprising, on a front, a contact terminal, which is situated in the housing, to a complementary male contact, this contact terminal being formed by at least one spring contact tine provided with a terminal part pointed towards the front of the contact, characterized in that said spring contact tine is constructed from a small strip that is joined to a rear of the top element, this small strip extending, prior to bending, towards the rear and, after bending, towards the front, wherein the contact further includes a stiffening device in a linking region between a rear zone of connection and the housing, the stiffening device being formed by arches (70, 71) joining a top part of the side walls (5, 6) and an extension of the bottom adjoining the crimp tabs (50, 51) of an electrical wire.

* * * * *